US006422337B1

(12) United States Patent
Tseng

(10) Patent No.: US 6,422,337 B1
(45) Date of Patent: Jul. 23, 2002

(54) LOUDSPEAKER WITH A SUSPENSION MEMBER MADE OF A LAMINATE

(75) Inventor: Jason Tseng, Taipei (TW)

(73) Assignee: Deccon International Ltd., Taipei (TW)

( * ) Notice: Subject to any disclaimer, the term of this patent is extended or adjusted under 35 U.S.C. 154(b) by 41 days.

(21) Appl. No.: 09/658,876

(22) Filed: Sep. 8, 2000

(30) Foreign Application Priority Data

Jun. 28, 2000 (TW) ..... 089211079

(51) Int. Cl.[7] ..... G10K 13/00; H04R 7/00
(52) U.S. Cl. ..... 181/171; 181/172
(58) Field of Search ..... 181/171, 172, 181/170, 167; 381/386, 392

(56) References Cited

U.S. PATENT DOCUMENTS 3,757,890 A * 9/1973 Dunning ..... 181/151
3,804,994 A * 4/1974 Turuga ..... 181/171
3,892,289 A * 7/1975 Rollins ..... 181/171
4,324,312 A * 4/1982 Durbin ..... 181/171
5,099,949 A * 3/1992 Mitobe ..... 181/171
5,782,867 A * 7/1998 Shrock et al. ..... 200/83 N
6,305,491 B2 * 10/2001 Iwasa et al. ..... 181/166
2001/0011615 A1 * 8/2001 Iwasa et al. ..... 181/172

FOREIGN PATENT DOCUMENTS

JP 55075396 A * 6/1980 ..... H04R/7/10
JP 55075397 A * 6/1980 ..... H04R/7/18
JP 61101195 A * 5/1986 ..... H04R/7/02
JP 01290399 A * 11/1989 ..... H04R/7/02

* cited by examiner

*Primary Examiner*—Robert E. Nappi
*Assistant Examiner*—Edgardo San Martin
(74) *Attorney, Agent, or Firm*—Morgan, Lewis & Bockius LLP

(57) ABSTRACT

An outer marginal edge of a loudspeaker cone is connected to an annular suspension member of laminated structure which supports the loudspeaker cone on a support frame. The annular suspension member includes a layer of cloth and a first layer of flexible plastic foam integrally bonded to the cloth. The first layer of foam has an inner surface in contact with the outer marginal edge, and the cloth covers an outer surface of the first layer of foam opposite to the inner surface. A second layer of foam which is thinner than the first layer of foam is disposed between and bonded integrally to the cloth and the first layer of foam. The suspension member is strong and durable and still exhibits good formability and flexibility.

4 Claims, 3 Drawing Sheets

LOUDSPEAKER WITH A SUSPENSION MEMBER MADE OF A LAMINATE

BACKGROUND OF THE INVENTION

1. Field of the Invention

The invention relates to a loudspeaker cone, particularly, to a loudspeaker cone which has an annular suspension member made of a laminate having a foam layer covered and strengthened by a cloth layer.

2. Description of the Related Art

It is known in the art to connect a voice coil 7 to a loudspeaker cone 1' and to connect the outer marginal edge of the loudspeaker cone 1' with a suspension rim 2', as shown in FIG. 1, so as to mount the loudspeaker cone 1' on a support frame via the suspension rim 2'. Typical materials suitable for making suspension rims include paper, rubber, textile materials, and foams. However, paper is prone to be torn at higher tones or higher amplitude vibrations due to its insufficient strength, and the durability thereof is low in humid environments so that high output power is impossible when paper is used in a suspension rim. Textile materials possess better strength and better formability than paper. But, as resins impregnating the textile materials are of less resiliency and flexibility, sound distortion of sound can occur at high output powers. While foams offer good response to high output powers and low frequencies as compared to paper and textile materials, they have poor strength and low humid-resistance and are susceptible to damage by insects and environmental factors. In addition, foams are color-degradable due to environmental conditions. Rubber works excellently at low frequencies, but has poor response to high frequencies. Moreover, it is prone to degradation due to temperature changes.

SUGARY OF THE INVENTION

An object of the present invention is to provide a loudspeaker cone with a suspension member which is strong, durable, and flexible but still exhibits smooth response to different frequency ranges and minimizes distortion.

According to the present invention, a loudspeaker 10 comprises: a loudspeaker cone having an outer marginal edge; and an annular suspension member of laminated structure, connected to the outer marginal edge and adapted to support the loudspeaker cone on a support frame. The annular suspension member includes a layer of cloth and a first layer of flexible plastic foam integrally bonded to the layer of cloth. The first layer of foam has an inner surface in contact with the outer marginal edge, and the layer of cloth covers an outer surface of the first layer of foam opposite to the inner surface. Preferably, the suspension member further has a second layer of foam between the cloth and the first layer of foam, which is thinner than the first layer of foam. The thickness of the second layer of foam is preferably less than 5 mm.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
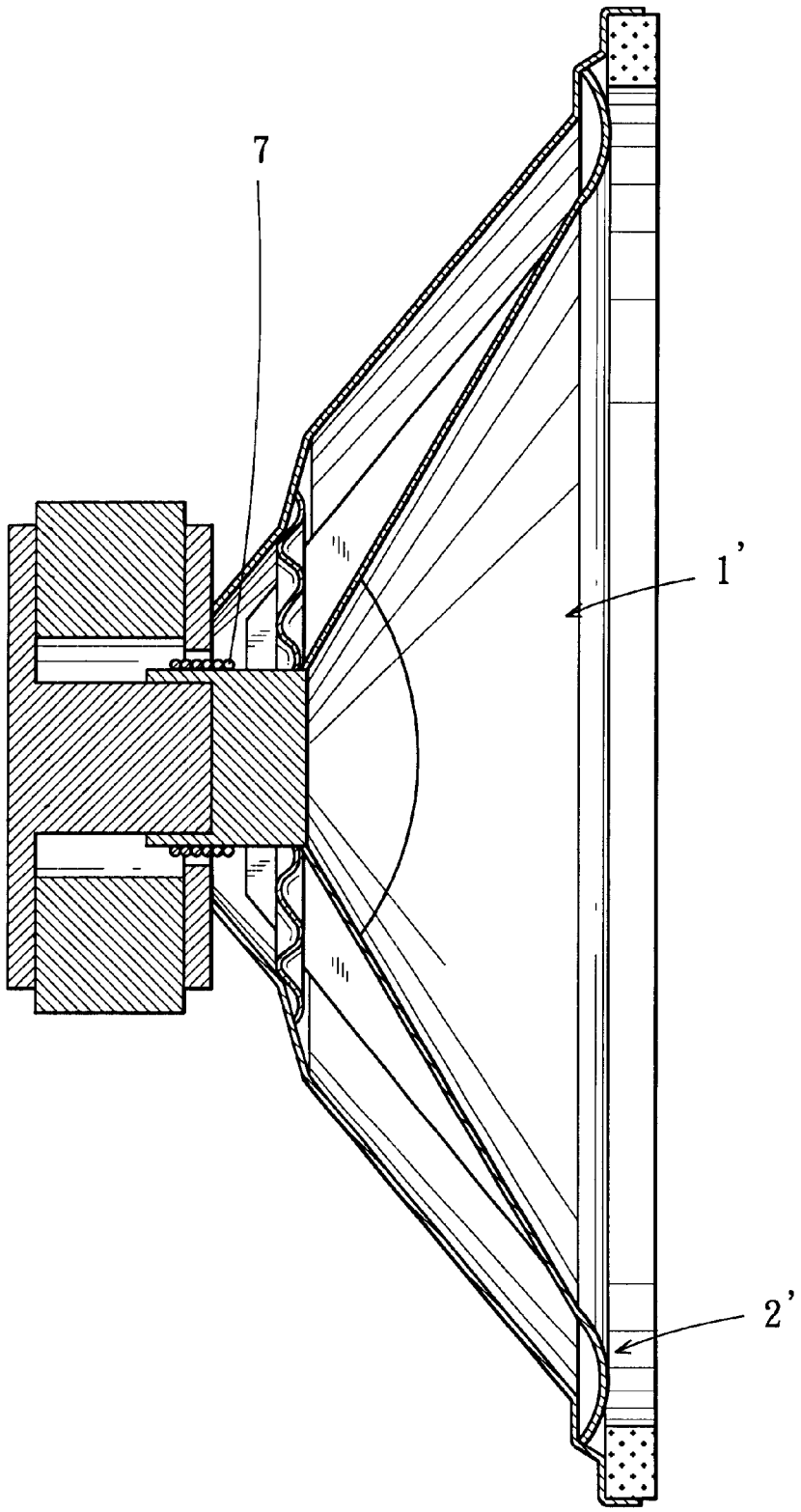
FIG. 1 PRIOR ART
FIG. 1 shows an assembly of the conventional loudspeaker cone and the conventional suspension rim.
Figure 2:
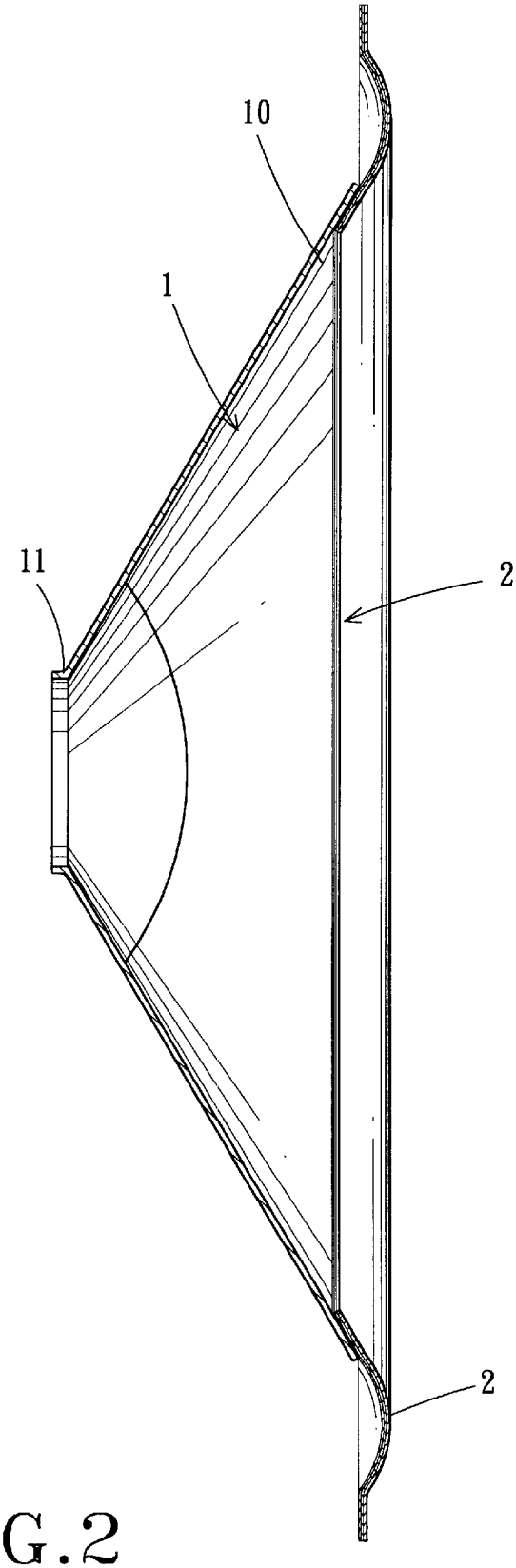
FIG. 2 shows an assembly of a loudspeaker cone and a suspension member made according to the present invention.
Figure 2A:
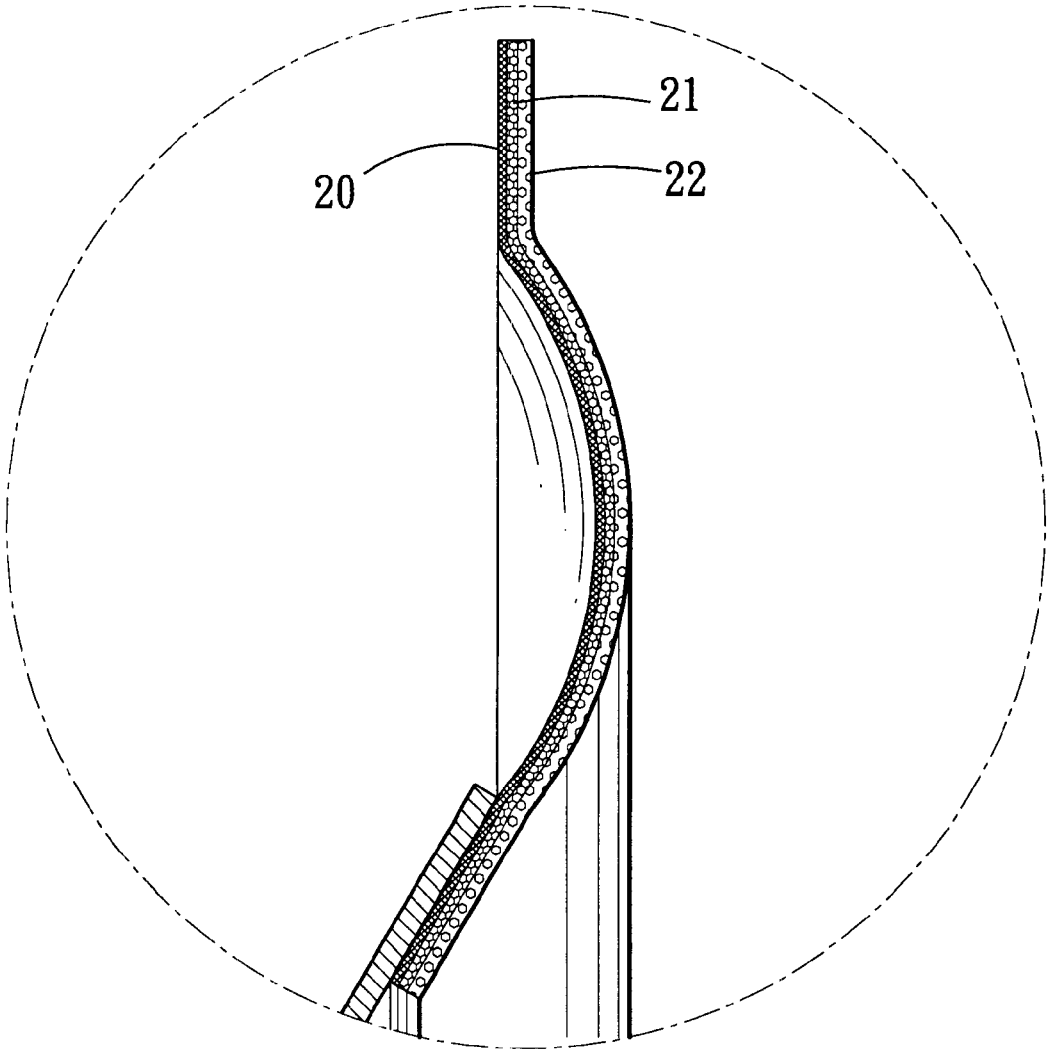
FIG. 2A is a fragmentary enlarged view showing a portion of the assembly of FIG. 2.

Referring to FIGS. 2 and 2A, an assembly embodying the present invention is shown to include a loudspeaker cone 1 which is fabricated in a conventional manner and which has a diverging end with an annular marginal edge 10 and a converging end formed with a neck 11 adapted to be connected to a voice coil or the like. The marginal edge 10 is connected to an annular suspension member 2 used to support the marginal edge 10 on a support frame (not shown) in a conventional manner.

According to the present invention, the annular suspension member 2 is of a laminated structure and includes a layer of cloth 22, a first layer of foam 20, and a second layer of foam 21 disposed between and bonded integrally to the layers of cloth 22 and foam 20. The annular suspension member 2 is connected to the marginal edge 10 of the loudspeaker cone 1 with an inner surface of the foam 20 in contact with the marginal edge 10. The layer of cloth 22 is disposed outwardly of and covers the foams 20 and 21.

The thickness of the second layer of foam 21 is smaller than that of the first layer of foam 20. Preferably, the foam 21 has a thickness of less than 5 mm, whereas the foam 20 has a thickness of about 35 mm. During fabrication, the foam 21 is bonded adhesively to the layer of cloth 22 prior to bonding the foam 20 to the foam 21 so that the cloth 22 can be stretched and stiffened to some degrees to thereby eliminate formation of wrinkles in the cloth 22. After the cloth 22 and foam 21 are bonded together, they are subjected to cutting to form a blank, which has an area larger than the cross-section of the marginal edge 10. Afterwards, the foam 20 is bonded adhesively to the surface of the foam 21, thus resulting in a three-layer laminate. The three-layer laminate is then cut to form an annulus and shaped to form the suspension member 2.

As the cloth 22 of the suspension member 2 can be colored easily, the suspension member 2 can be provided with a desired color according to the need of the customer. In addition, due to the use of the cloth 22 as an outer layer, the foam layers 21 and 20 can be protected from being destroyed by insects and the like or being affected by environmental factors.

The loudspeaker cone according to the present invention provides the following advantages:

1. Unlike the conventional suspension rim using a resin-impregnated cloth, the cloth 22 which is lined by the foam layers 21 and 20 according to the present invention can exhibit good flexibility while still being formable together with the foam layers 21 and 20. The loudspeaker cone with the suspension member 2 of the present invention can exhibit smooth response to different frequency ranges and light weight and minimize distortion.

2. Since the suspension member can be easily colored, variations in the appearance of the loudspeaker cone can be facilitated.

3. Since the outer layer of the suspension member is cloth, the durability of the suspension member is excellent and the suspension member can be protected from damage by insects and environmental factors.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A loudspeaker comprising:

a loudspeaker cone having an outer marginal edge; and an annular suspension member of laminated structure, connected to said outer marginal edge and adapted to support said loudspeaker cone on a support frame, said annular suspension member including a layer of cloth and a first layer of flexible plastic foam integrally bonded to said layer of cloth, said first layer of foam having an inner surface in contact with said outer marginal edge, said layer of cloth covering an outer surface of said first layer of foam opposite to said inner surface, wherein said annular suspension member further includes a second layer of foam disposed between and bonded integrally to both of said layer of cloth and said first layer of foam, said second layer of foam having a thickness which is smaller than that of said first layer of foam and lining said layer of cloth so as to provide a degree of stiffness and to eliminate wrinkles.

2. The loudspeaker as claimed in claim 1, wherein the thickness of said second layer of foam is less than 5 mm.

3. The loudspeaker as claimed in claim 2, wherein said first layer of foam has a thickness of about 35 mm.

4. The loudspeaker as claimed in claim 1, wherein said second layer of foam is bonded to said layer of cloth before said first layer of foam is bonded to said second layer of foam.

* * * * *